United States Patent [19]

Zernig

[11] 4,319,382

[45] Mar. 16, 1982

[54] CABINET FURNITURE WITH HINGED FRONT DOOR CONTAINING BUILT-IN APPLIANCE

[75] Inventor: Ernst Zernig, Hemer, Fed. Rep. of Germany

[73] Assignee: Richard Heinze GmbH & Co. KG, Herford, Fed. Rep. of Germany

[21] Appl. No.: 55,256

[22] Filed: Jul. 6, 1979

[30] Foreign Application Priority Data

Jul. 17, 1978 [DE] Fed. Rep. of Germany ..... 2831355

[51] Int. Cl.[3] ..... E05D 3/06; E05D 3/08; E05D 3/10; E05D 15/52

[52] U.S. Cl. ..... 16/251; 16/297; 16/302; 16/365

[58] Field of Search ..... 16/135, 164, 165

[56] References Cited

U.S. PATENT DOCUMENTS

| | | | |
|---|---|---|---|
| 3,066,349 | 12/1962 | Youngdale | 16/135 X |
| 3,605,173 | 9/1971 | Lautenschlager, Jr. | 16/164 X |
| 3,744,086 | 7/1973 | Salice et al. | 16/164 |
| 4,133,143 | 1/1979 | Campisano | 16/135 X |

FOREIGN PATENT DOCUMENTS

| | | | |
|---|---|---|---|
| 248280 | 7/1966 | Austria | 16/164 |
| 855907 | 11/1970 | Canada | 16/164 |
| 2412169 | 11/1975 | Fed. Rep. of Germany | 16/135 |
| 2541144 | 3/1977 | Fed. Rep. of Germany | 16/164 |
| 689565 | 4/1965 | Italy | 16/164 |

*Primary Examiner*—Wayne L. Shedd

*Attorney, Agent, or Firm*—Pollock, Vande Sande & Priddy

[57] ABSTRACT

A cabinet which contains an appliance such as a refrigerator is provided with novel hinges having one member secured to the body of the appliance and the other member adapted to carry both the door of the appliance and the door of the cabinet for simultaneous operation. The hinge members are interconnected in a known manner by means of connecting links pivotally mounted at each end to the respective member. A spring may be incorporated in each hinge for biassing the doors into the closed position.

8 Claims, 9 Drawing Figures

(II-II)

(VIII-VIII)

CABINET FURNITURE WITH HINGED FRONT DOOR CONTAINING BUILT-IN APPLIANCE

Figure 1:
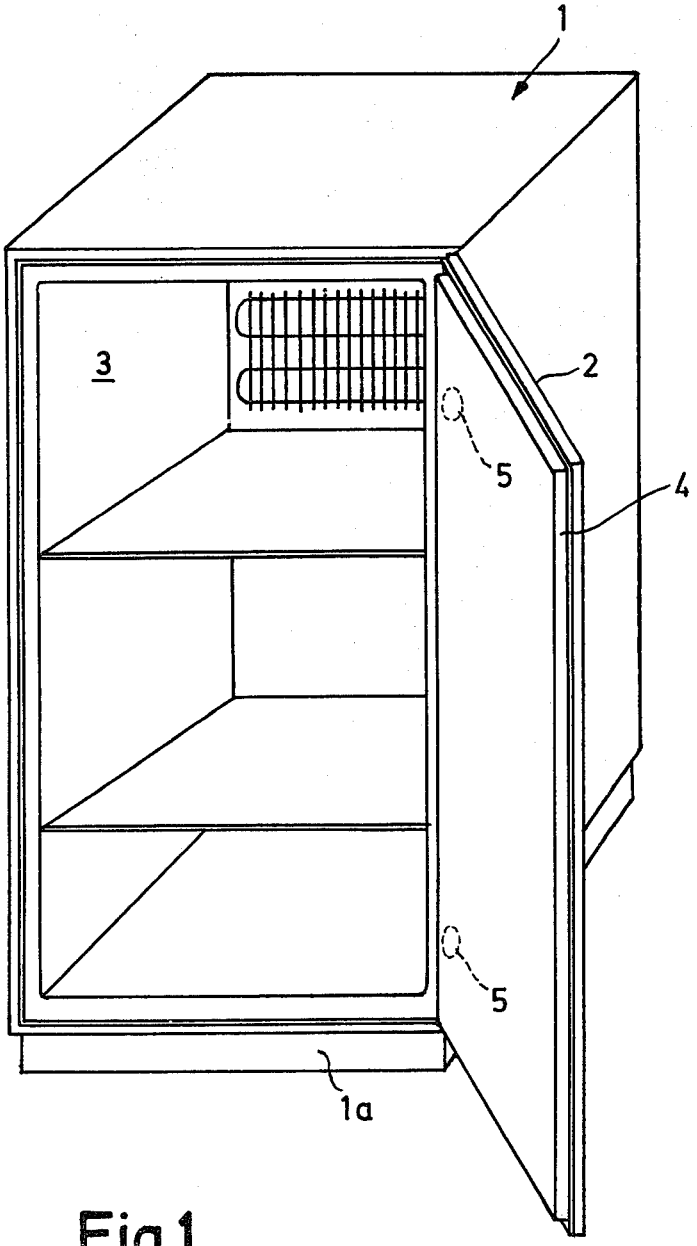

The invention concerns cabinet furniture with a hinged front door and an appliance such as a refrigerator unit having its own front door installed within the cabinet, wherein the hinge consists of a hinge arm that is affixed to an exterior side wall of the installed appliance and is connected by means of two pivotally connected links to a mounting plug embedded in a recess in the front door of the cabinet.

In kitchen units it is known to completely enclose appliances, in particular refrigerators, within a cabinet. With this known arrangement, the cabinet containing the appliance and the appliance itself each operate independently. The front door of the cabinet is then connected by means of a mechanism to the front door of the appliance, which ensures that when the front door of the cabinet is opened, the front door of the appliance is opened simultaneously. Such a solution is not only technically exacting and therefore expensive, but also requires a substantial amount of additional space compared to an appliance which is not enclosed.

It is further known to place appliances, for example refrigerators, between neighboring cabinets of kitchen units and to conceal the front of the refrigerator behind a covering which has the same color and surface structure as the adjacent cabinet doors. This solution requires comparatively little space, but fails to provide the desired homogeneous appearance of a kitchen unit in which one cannot see behind which of the closed doors an appliance might be installed.

Based on this state of the art, the purpose of the invention is to provide cabinet furniture of the initially mentioned type, which has an appearance as perfect as that of the arrangement first discussed, but which is cheaper to produce and has a lower space requirement.

To achieve this purpose with cabinet furniture of the initially mentioned type, the hinge is provided with an arm that is secured to the side wall of the installed appliance, a mounting plug adapted to be set into a recess in the cabinet door is attached by links to the hinge arm, and at least one securing flange is formed on the mounting plug which mates with the adjacent edge of the appliance door and is secured thereto to extend substantially perpendicular to the plane of the appliance front door.

For cabinet furniture with a built-in appliance in accordance with the invention, a single set of hinges only is sufficient to carry both the door of the appliance and the covering door of the cabinet. When assembled, one cannot tell from the cabinet door that an appliance is installed within the cabinet. The door of the cabinet furniture can blend in complete harmony with the appearance of the surrounding cabinets. The hinge arm is easily fitted to the appliance side wall which is manufactured within narrow tolerances, for example by simply screwing it on.

In a preferred embodiment of the invention, the hinge arm has a U-shaped cross section which is open towards the adjacent cabinet side wall, and the base of which is placed against the external surface of the appliance side wall and secured thereto by means of screws through holes provided in the said base.

It has furthermore proved convenient to have a flange, integrally formed with the mounting plug, which extends parallel to the plane of the cabinet front door, lies against the surface of the appliance door and is secured by means of screws to the door of the appliance.

It has furthermore proved convenient that the mounting plug is formed like a cylindrical pot on which the flange extending parallel to the plane of the cabinet front door is arranged on the side diametrically opposite to the connecting links, and two flanges for securing the appliance door to the cabinet door are arranged on the sides of the plug symmetrically about a center-line through the middle of the connecting links and the middle of the mounting plug.

With this embodiment, the appliance door is secured to the mounting plug by a total of three flanges. The two laterally arranged flanges mate with the edge of the appliance door, and the single flange extending parallel to the plane of the cabinet front door is applied to the surface of the appliance door. Screws are fitted through the said flanges into corresponding nuts provided in the appliance door.

In another embodiment of the invention, the hinge arm is provided with longitudinally arranged elongated holes, and the flanges formed on the mounting plug are provided with elongated holes arranged transversely thereto. This arrangement of the elongated holes makes possible adjustment of the appliance door and of the cabinet door relative to one another and relative to the appliance.

Conveniently, the hole in the flange which extends parallel to the front door of the cabinet is chamfered to receive the head of a securing screw. Countersinking the screw makes it possible to leave the inner surface of the cabinet door plane.

In a preferred embodiment of the invention, the hinge takes the form of a retaining hinge.

With such hinges, a leaf spring with bent over ends is provided, one end of which engages a surface of the hinge arm, and the other end of which embraces the pivot bearing of the second conecting link, near the middle of the mounting plug.

Such an embodiment integrates a retaining means into the hinge which is reliable, extremely cheap to manufacture and easy to assemble, and ensures that the appliance door is retained firmly closed. This is particularly important when the appliance is a refrigerator. The closing and retaining pressure exerted by the hinge must be sufficiently powerful to close the switch for the refrigerator internal lamp, and to overcome the air cushion effect created by the closing door of the refrigerator. Furthermore, it is possible to ensure that the closing pressure increases continuously from about 45° open to fully closed.

Finally, it is proposed according to the invention that a plastic spacer be provided which covers the free end of the hinge arm. A plastic cover and spacer of this kind has additionally a protective function and prevents damage to the inner surface of the cabinet side walls when the appliance is pushed into the cabinet.

Figure 1A:
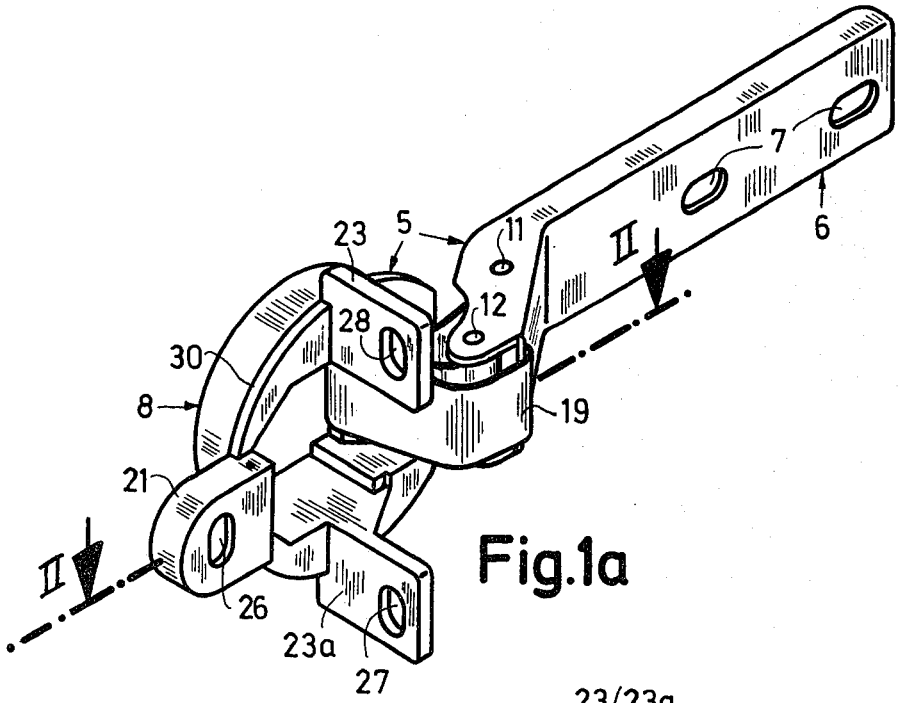
Figure 3:
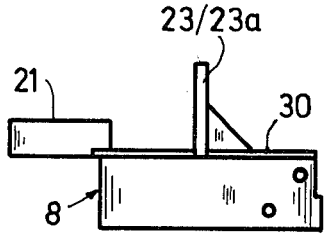
Figure 2:
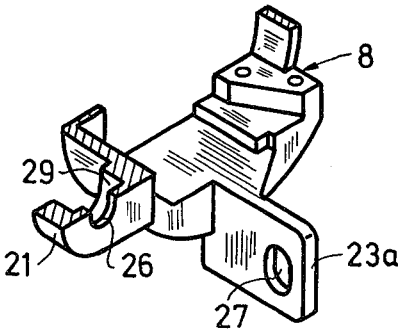
Figure 4:
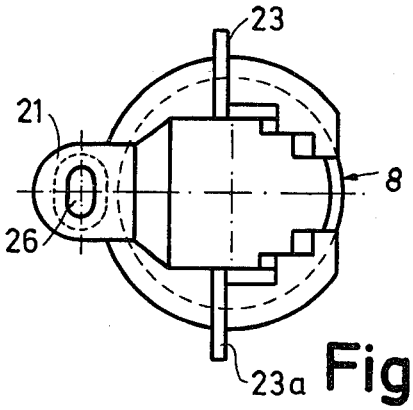
Figure 5:
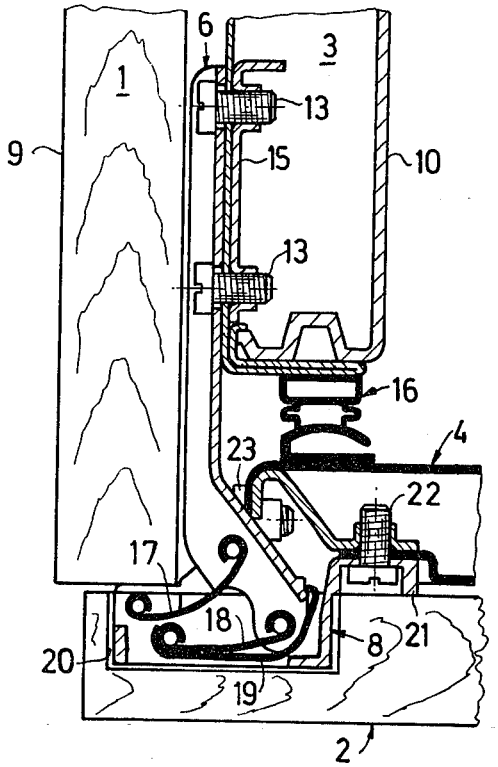
Figure 6:
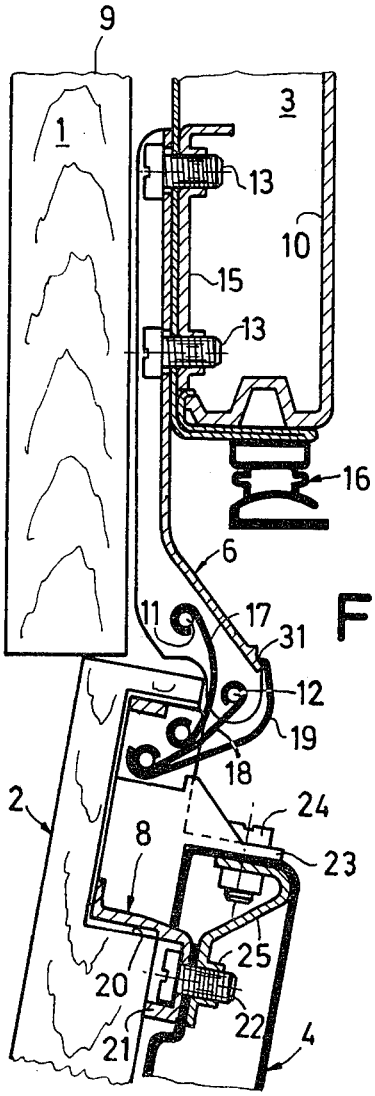
Figure 8:
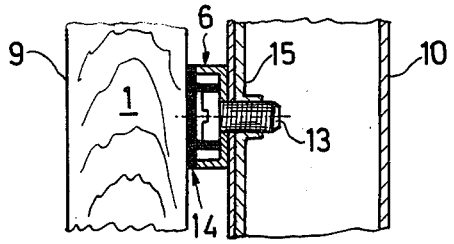
Figure 7:
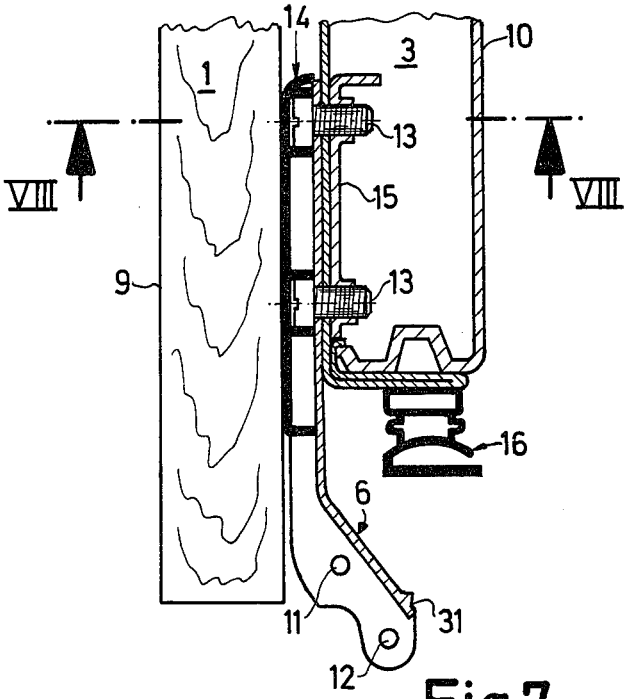

In the following, a preferred embodiment of the invention will be described in detail with the aid of the drawings. Showing in:

FIG. 1 a perspective view of the cabinet with assembled refrigerator and the doors of the cabinet and the refrigerator are shown open, the doors being fitted to the right hand side of the cabinet, FIG. 1*a* a perspective view of the hinge in the open position, FIG. 2 a perspective cross section taken in the plane II—II through the lower part of the hinge mounting plug as shown in FIG. 1*a*, FIG. 3 a side view of the mounting plug, FIG. 4 a plan view showing the inside of the mounting plug, FIG. 5 a horizontal section through a hinge in the door-closed position and fitted, unlike FIG. 1, to the left hand side of the cabinet, FIG. 6 a section as in FIG. 5 but with the door open, FIG. 7 a horizontal section analogous to FIG. 5 but with the doors of the cabinet and the appliance omitted, and of the hinge only the hinge arm shown, FIG. 8 a section through the vertical plane VIII—VIII of FIG. 7.

The body 3 of an appliance is installed within the body of a cabinet 1 mounted on a base 1*a*. The door 2 of the cabinet and the door 4 of the appliance are secured by hinge means 5 to the body 3 of the appliance.

The hinge 5 has a hinge arm 6 with elongated holes 7 through which the securing screws 13 are set when assembled. The securing screws 13 are self-tapping, and a metal plate 15 is provided within the side wall 10 of the appliance body 3 into which they are screwed. Securing the hinge arm 6 by means of screws 13 would appear to be the simplest method. Other methods, however, are also conceivable as, for example, fitted or integrally formed sockets or receiving holes in or on the appliance body 3 to which the hinge arm 6 is fixed and secured by friction and/or form-lock (groove-and-tongue connection).

Also, the sockets or receiving holes on the one hand and the hinge arm 6 on the other hand could be so formed that a T-shaped or swallow-tail section results, and longitudinal securing of the hinge arm 6 only is required. For this, known means such as integral, spring biassed, latching means may be incorporated. The hinge arm 6 has a U-shaped cross-sectional shape and, when assembled, the base or back thereof is applied to the outer surface of the side wall 10 of the appliance 3. The open end of the U-shaped profile extends toward the inside of the side wall 9 of the cabinet 1. Two bearings 11 and 12 are provided in the sloping region of the hinge arm 6 in which mounting pins for a first connecting link 17 and a second connecting link 18 are provided.

The other end of each link 17 and 18 is pivotally mounted inside a mounting plug 8. The angled end of a curved leaf spring 19 is biassed against a notch 31 in the hinge arm 6. The other end of the leaf spring 19 embraces the pivot bearing of the second connecting link 18 within the mounting plug 8.

The mounting plug 8 has the form of a cylindrical pot with a collar 30 which overlaps a bore 20, into which plug 8 is set, in cabinet door 2.

In FIGS. 7 and 8, a cover and spacer 14 made of plastic can be seen, with its back against the inner surface of the cabinet side wall 9.

A flange 21 which extends parallel to the plane of the cabinet door 2 is provided on the mounting plug 8 opposite the connecting links and the leaf spring 19. The flange 21 has a recess 29 at the back and an elongated hole 26. The recess 29 takes the head of a screw 22 which is inserted through the elongated hole 26 and screwed into a screw hole in the door 4 of the appliance or into threaded mounting plate 25 secured therein.

On opposite sides of the mounting plug 8, two side flanges 23 and 23*a* project in a plane which is perpendicular to the plane of the flange 21. These flanges 23 and 23*a* mate with the edge of the adjacent appliance door. The flanges 23 and 23*a* have vertically elongated holes 27 and 28 through which securing screws 24 are set and screwed into nuts or into the threaded mounting plate 25 inside the appliance door 4. It is also possible to secure the mounting plug 8 by means of integrally formed or subsequently fitted folding studs or straddling dowels, since rapid-fitting securing means of these types have long been known in the art.

FIGS. 5 to 8 also show the magnetic sealing strip 16 of the appliance 3.

The receiving bore 20 in cabinet door 2 has a diameter which is greater than the external diameter of the mounting plug 8. Because of this, it is possible to move and thus adjust the front door 2 of the cabinet relative to the appliance door 4. The front door 2 of the cabinet can be secured to the appliance door 4 in any desired manner, for example by screws through the appliance door or by glueing in the adjusted position.

Unlike the embodiments shown, it is also possible to provide flanges on the mounting plug 8 which are not all connected to the appliance door 4, but where one or more flanges are connected to the door of the appliance and the remaining flanges are connected to the door of the cabinet.

I claim:

1. In a furniture arrangement of the type comprising a cabinet having an appliance such as a refrigerator installed within the interior of the cabinet, the cabinet having an outer door and the appliance having a separate outer door located behind the cabinet door, the cabinet and appliance doors being interconnected to one another to provide a composite door which may be opened as a unit to simultaneously open the cabinet and appliance, the improvement comprising a hinge having an elongated hinge arm which is secured to a side wall of said appliance at a location within said cabinet, said hinge arm extending forwardly from said appliance side wall toward the doors of said cabinet and appliance, a mounting plug pivotally connected to the forward end of said elongated hinge arm, said mounting plug being embedded within a recess located in the rear interior side of said cabinet door, and said mounting plug having at least one flange extending outwardly of said plug in substantially perpendicular relation to the plane of said cabinet door, said flange being attached to a side edge of said appliance door, whereby said hinge interconnects said cabinet and appliance doors to one another and hingedly connects the interconnected doors as a unit only to the side wall of said installed appliance.

2. The structure of claim 1 wherein said hinge arm has a U-shaped cross section the base of which is attached to an external surface of said appliance side wall, the open side of said U-shaped cross section facing an interior side wall of said cabinet.

3. The structure of claim 1 wherein said mounting plug has at least one further flange which extends in substantially parallel relation to the plane of said cabinet door, said further flange being attached to the front surface of said appliance door.

4. The structure of claim 3 wherein said mounting plug is of cylindrical pot configuration, said mounting plug being pivotally connected to the forward end of said hinge arm by at least one connecting link which extends between said forward end of said hinge arm and a pivot point located within said plug adjacent one side of said plug, said further flange extending outwardly of said plug in substantially parallel relation to said cabinet door from the side of said plug diametrically opposite to said pivot point, and said first mentioned substantially perpendicular flange extending outwardly of said plug substantially along the central axis of said cylindrical plug.

5. The structure of claim 3 wherein said hinge arm and said flanges are each provided with elongated mounting holes for permitting adjustment of the mounting positions of said arm and flanges relative to said doors and appliance side wall, the direction of elongation of the mounting holes in said hinge arm being transverse to the direction of elongation of the mounting holes in said flanges.

6. The structure of claim 3 wherein said further flange is provided with a recess for receiving the head of a screw that secures said further flange to said appliance door.

7. The structure of claim 3 including a leaf spring extending between said hinge arm and said plug for biasing said doors toward a closed position.

8. The structure of claim 1 wherein said hinge arm is attached to an exterior surface of said appliance side wall, and a plastic cover overlying said hinge arm.

* * * * *